US012152510B2

(12) United States Patent
Tawab et al.

(10) Patent No.: US 12,152,510 B2
(45) Date of Patent: Nov. 26, 2024

(54) THERMAL ENERGY STORAGE POWER PLANT

(71) Applicants: KABUSHIKI KAISHA TOSHIBA, Tokyo (JP); TOSHIBA ENERGY SYSTEMS & SOLUTIONS CORPORATION, Kawasaki (JP)

(72) Inventors: Taufiq Hilal Tawab, Tokyo (JP); Toyohiro Akebi, Tokyo (JP); Jianda Goh, Yokohama Kanagawa (JP); Hiromutsu Miki, Yokohama Kanagawa (JP); Keiko Shimizu, Kawasaki Kanagawa (JP); Masakazu Shirakawa, Yokohama Kanagawa (JP); Atsushi Matsuzaki, Sagamihara Kanagawa (JP); Takahiro Mori, Yokohama Kanagawa (JP); Hironori Watanabe, Yokohama Kanagawa (JP); Yusuke Fukamachi, Tokyo (JP); Syuntaro Abe, Tokyo (JP); Chikako Iwaki, Tokyo (JP)

(73) Assignees: KABUSHIKI KAISHA TOSHIBA, Tokyo (JP); TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 0 days.

(21) Appl. No.: 18/274,413

(22) Filed: Jul. 26, 2023

(65) Prior Publication Data

US 2024/0240575 A1 Jul. 18, 2024

Related U.S. Application Data

(63) Continuation-in-part of application No. PCT/JP2021/043867, filed on Nov. 30, 2021.

(30) Foreign Application Priority Data

Apr. 1, 2021 (JP) ..... 2021-063111

(51) Int. Cl.
*F01K 3/08* (2006.01)
*F01K 3/18* (2006.01)
(Continued)

(52) U.S. Cl.
CPC ..... *F01K 3/08* (2013.01); *F01K 3/185* (2013.01); *F01K 15/00* (2013.01); *F22B 1/16* (2013.01); *F28D 20/00* (2013.01)

(58) Field of Classification Search
CPC . F01K 3/08; F01K 3/185; F01K 15/00; F22B 1/16; F28D 20/00
(Continued)

(56) References Cited

U.S. PATENT DOCUMENTS 4,171,617 A 10/1979 Sakamoto et al.
4,428,190 A * 1/1984 Bronicki ..... F01K 3/04 60/659
(Continued)

FOREIGN PATENT DOCUMENTS

EP 3 327 399 B2 5/2018
JP S53-059155 A 5/1978
(Continued)

OTHER PUBLICATIONS

International Search Report and Written Opinion of International Patent Application No. PCT/JP2021/043867 dated Feb. 22, 2022, with English translation (10 pages).

*Primary Examiner* — Hoang M Nguyen
(74) *Attorney, Agent, or Firm* — Foley & Lardner LLP

(57) ABSTRACT

In one embodiment, a thermal energy storage power plant includes a thermal accumulator to accumulate thermal energy and heat a thermal medium with the thermal energy, and a steam generator to generate steam using the thermal medium. The plant further includes a first path to convey the thermal medium from the accumulator to the generator, and
(Continued)

a second path to convey the thermal medium from the generator to the accumulator. The plant further includes an auxiliary module provided on the first path, and a bypass path to convey the thermal medium flowing through the second path to the auxiliary module by bypassing the accumulator, wherein the auxiliary module is supplied with a first thermal medium from the accumulator via the first path, supplied with a second thermal medium from the second path via the bypass path, and supplies a third thermal medium to the generator via the first path.

15 Claims, 7 Drawing Sheets

(51) Int. Cl.

| | |
|---|---|
| ***F01K 15/00*** | (2006.01) |
| ***F22B 1/16*** | (2006.01) |
| ***F28D 20/00*** | (2006.01) |

(58) Field of Classification Search
USPC ..... 60/659
See application file for complete search history.

(56) References Cited

U.S. PATENT DOCUMENTS

| | | | | |
|---|---|---|---|---|
| 8,136,358 | B1 * | 3/2012 | Brostmeyer | F22B 1/028 60/659 |
| 9,683,557 | B2 | 6/2017 | Yoshida et al. | |
| 2013/0306058 | A1 | 11/2013 | Goto et al. | |
| 2018/0245485 | A1 * | 8/2018 | Conlon | F22B 1/006 |
| 2019/0301309 | A1 * | 10/2019 | Huntington | F22B 1/16 |

FOREIGN PATENT DOCUMENTS

| | | | |
|---|---|---|---|
| JP | 2013-242070 | A | 12/2013 |
| JP | 5461666 | B1 | 4/2014 |
| JP | 2020-125857 | A | 8/2020 |
| WO | WO-2012/120556 | A1 | 9/2012 |

* cited by examiner

THERMAL ENERGY STORAGE POWER PLANT

CROSS REFERENCE TO RELATED APPLICATIONS

This application is a bypass continuation of International Patent Application No. PCT/JP2021/043867, filed on Nov. 30, 2021, which claims the benefit of priority from the prior Japanese Patent Application No. 2021-063111, filed on Apr. 1, 2021. The entire contents of these applications are incorporated herein by reference.

FIELD

Embodiments described herein relate to a thermal energy storage power plant.

BACKGROUND

FIG. 1 is a schematic view illustrating a configuration of a conventional thermal energy storage power plant.

The thermal energy storage power plant in FIG. 1 includes a heating module 1, a thermal accumulator 2, a thermal inlet fan 3, a steam generator 4, a power generator 5, a steam turbine 6, a turbine control valve 7, a turbine bypass valve 8, a condenser 9, and a condenser pump 10.

Operations of the thermal energy storage power plant in FIG. 1 are divided into two processes. A first process is a thermal storage process and a second process is a heat dissipation process.

The heating module 1 is a portion that generates thermal energy. The heating module 1 supplies the thermal accumulator 2 with enough thermal energy to operate the thermal energy storage power plant. The thermal accumulator 2 accumulates the thermal energy supplied from the heating module 1. In this manner, the thermal storage process is performed by the heating module 1 and the thermal accumulator 2.

On the other hand, the heat dissipation process is performed by the thermal accumulator 2, the thermal inlet fan 3, and the steam generator 4 using a thermal medium. The thermal accumulator 2 heats the thermal medium using thermal energy stored in the thermal accumulator 2 and supplies the steam generator 4 with the thermal medium. The steam generator 4 heats water using the thermal energy of the thermal medium supplied from the thermal accumulator 2 and generates steam from the water. As a result, the thermal medium is cooled in the steam generator 4 and is discharged from the steam generator 4 together with waste heat. The thermal inlet fan 3 returns the thermal medium discharged from the steam generator 4 to the thermal accumulator 2. In this manner, the thermal energy accumulated in the thermal accumulator 2 is dissipated to the steam generator 4.

The steam turbine 6 is supplied with steam (main steam) generated in the steam generator 4 and is rotationally driven by the steam. The steam is discharged from the steam turbine 6 together with waste heat and flows into the condenser 9. The power generator 5 is rotationally driven by the steam turbine 6 and generates power or, in other words, converts kinetic energy into electric power. The condenser 9 accepts steam discharged from the steam turbine 6 and returns the steam to water. The condenser pump 10 feeds water (feedwater) discharged from the condenser 9 to the steam generator 4. In this manner, water and steam are circulated among the steam generator 4, the steam turbine 6, the condenser 9, and the condenser pump 10.

The turbine control valve 7 is used to adjust a flow rate of steam to be supplied to the steam turbine 6 from the steam generator 4. The turbine bypass valve 8 is used to cause steam supplied from the steam generator 4 to bypass the steam turbine 6 to be discarded to the condenser 9.

DETAILED DESCRIPTION

Embodiments will now be explained with reference to the accompanying drawings. In FIGS. 1 to 7, same components will be denoted by same reference signs and redundant descriptions will be omitted.

Figure 1:
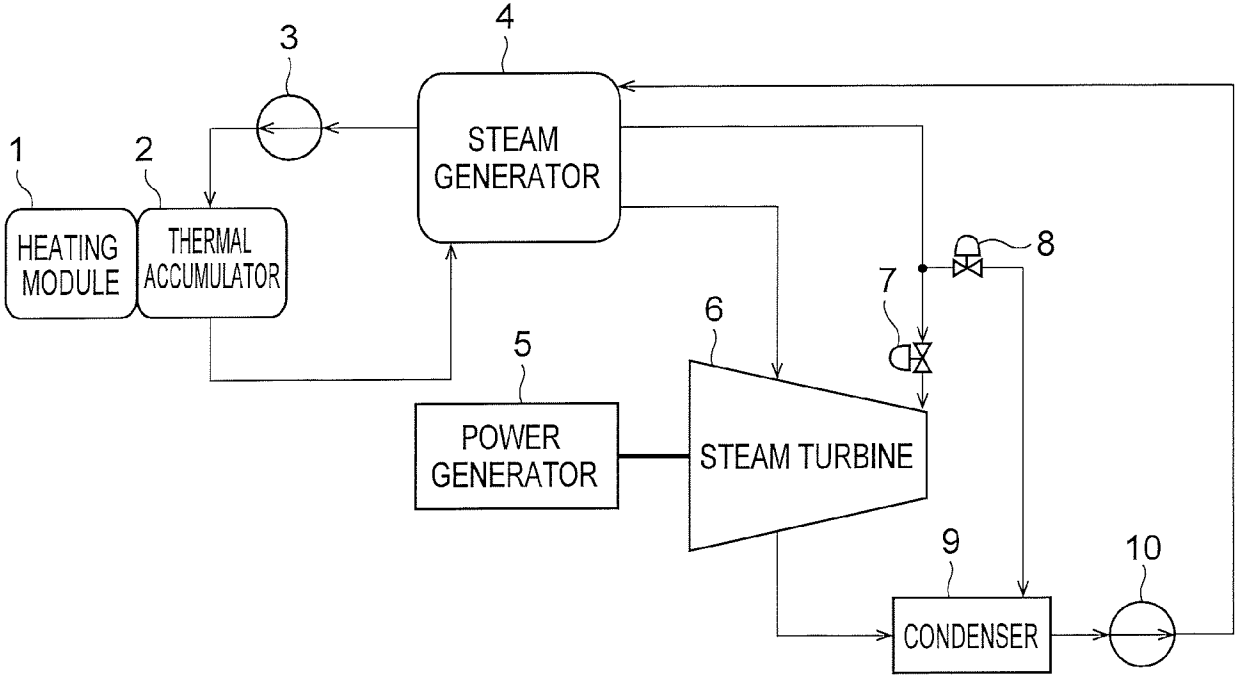
FIG. 1 is a schematic view illustrating a configuration of a conventional thermal energy storage power plant.

The thermal energy storage power plant in FIG. 1 has the following problems which make it difficult to realize efficient operations of the plant.

First, load control of the thermal energy storage power plant in FIG. 1 is performed by controlling, with the control valve 7, an amount of thermal energy that flows into the steam turbine 6. When a setting value of load of the plant is lower than the thermal energy that flows into the steam turbine 6, excess thermal energy is being supplied from the steam generator 4. In this case, the control valve 7 is closed, the turbine bypass valve 8 is opened, and the thermal energy is discarded to the condenser 9. As a result, efficiency of the plant declines.

In addition, a temperature of the thermal medium that is sent from the thermal accumulator 2 to the steam generator 4 must satisfy a design condition of the steam generator 4. The temperature of the thermal medium that is sent from the thermal accumulator 2 to the steam generator 4 is dependent on the amount of thermal energy dissipated from the thermal accumulator 2. When a large amount of thermal energy is dissipated and the temperature of the thermal medium rises, the temperature of the thermal medium may possibly exceed the design condition of the steam generator 4 and may possibly adversely affect the steam generator 4.

Furthermore, an amount of heat Q of a thermal storage material in the thermal accumulator 2 bears a proportionate relationship to a mass M of the thermal storage material, a specific heat Cp of the thermal storage material, and a difference in temperature $\Delta T$ ($=T1-T2$) between a heat input temperature T1 to the thermal accumulator 2 and a heat output temperature T2 ($Q=M\times Cp\times\Delta T$). Therefore, when the thermal accumulator 2 is at a high temperature and unable to accumulate heat due to an effect of the design condition of the steam generator 4, the heat input temperature T1 to the thermal accumulator 2 drops. As a result, the mass M of the thermal storage material must be increased in order to obtain a target amount of heat Q and a wide space becomes necessary to install the thermal accumulator 2.

What is more, when a constraint is placed on the heat input temperature T1 to the thermal accumulator 2, a latent heat thermal storage material (for example, an alloy PCM (Phase Change Material)) or a chemical thermal storage material (for example, $LiSiO_4$) capable of storing heat at higher temperatures cannot be used as the thermal storage material and the types of the thermal storage material in the thermal accumulator 2 become limited.

In addition, since the thermal energy storage power plant in FIG. 1 is not configured to perform forced cooling of the steam generator 4 during maintenance of the plant or the like, it takes a long time to start maintenance of the steam generator 4.

In one embodiment, a thermal energy storage power plant includes a thermal accumulator configured to accumulate thermal energy supplied from a heating module, and heat a thermal medium with the thermal energy, and a steam generator configured to generate steam using the thermal medium heated by the thermal accumulator. The plant further includes a first flow path configured to convey the thermal medium from the thermal accumulator to the steam generator, and a second flow path configured to convey the thermal medium from the steam generator to the thermal accumulator. The plant further includes an auxiliary module provided on the first flow path, and a bypass flow path configured to convey the thermal medium flowing through the second flow path to the auxiliary module by bypassing the thermal accumulator, wherein the auxiliary module is supplied with a first thermal medium as the thermal medium from the thermal accumulator via the first flow path, supplied with a second thermal medium as the thermal medium from the second flow path via the bypass flow path, and supplies a third thermal medium as the thermal medium to the steam generator via the first flow path.

First Embodiment

Figure 2:
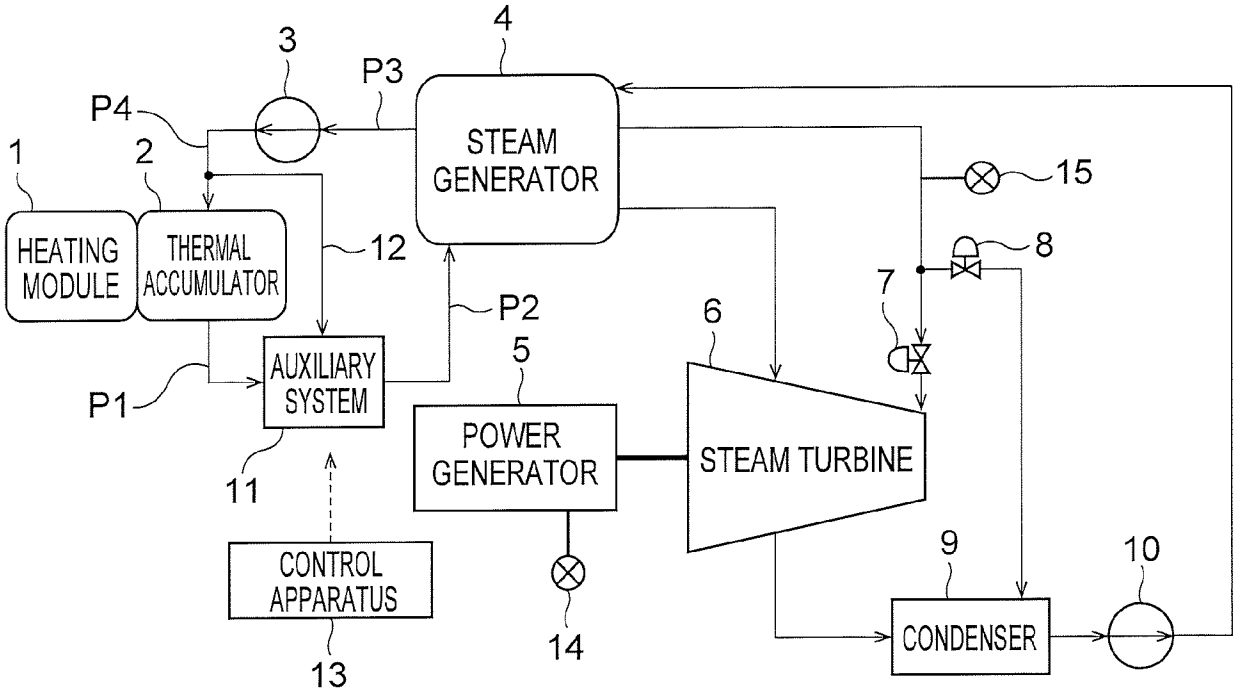
FIG. 2 is a schematic view illustrating a configuration of a thermal energy storage power plant of a first embodiment.

FIG. 2 is a schematic view illustrating a configuration of a thermal energy storage power plant of a first embodiment.

In a similar manner to the thermal energy storage power plant in FIG. 1, the thermal energy storage power plant in FIG. 2 includes the heating module 1, the thermal accumulator 2, the thermal inlet fan 3, the steam generator 4, the power generator 5, the steam turbine 6, the turbine control valve 7, the turbine bypass valve 8, the condenser 9, and the condenser pump 10. Functions and operations of the components are as described with reference to FIG. 1. The heating module 1 is, for example, an electrical heater. The thermal accumulator 2 is, for example, a thermal storage tank using crushed stone.

The thermal energy storage power plant in FIG. 2 further includes an auxiliary system 11, a bypass line 12, a control apparatus 13, a power generation amount detector 14, and a pressure detector 15. The auxiliary system 11 is an example of the auxiliary module and the bypass line 12 is an example of the bypass flow path. The power generation amount detector 14 is an example of the power generation detector and the pressure detector 15 is an example of the steam detector.

FIG. 2 further illustrates, as a flow path of the thermal medium, a line P1 from the thermal accumulator 2 to the auxiliary system 11, a line P2 from the auxiliary system 11 to the steam generator 4, a line P3 from the steam generator 4 to the thermal inlet fan 3, and a line P4 from the thermal inlet fan 3 to the thermal accumulator 2. The thermal medium is, for example, air. The thermal inlet fan 3 can cause the thermal medium to circulate between the thermal accumulator 2 and the steam generator 4 via the lines P1 to P4. While the thermal inlet fan 3 is disposed between the line P3 and the line P4 on a flow path from the steam generator 4 to the thermal accumulator 2 in FIG. 2, the thermal inlet fan 3 may be disposed instead on the line P1 or the line P2 on the flow path from the thermal accumulator 2 to the steam generator 4. The lines P1 and P2 are examples of the first flow path and the lines P3 and P4 are examples of the second flow path. The thermal inlet fan 3 is an example of the rotating device.

The auxiliary system 11 is disposed between the line P1 and the line P2 on the flow path from the thermal accumulator 2 to the steam generator 4. The bypass line 12 is connected to the line P4 and to the auxiliary system 11 and is capable of conveying the thermal medium flowing through the line P4 to the auxiliary system 11 by bypassing the thermal accumulator 2. In the present embodiment, a connection point of the line P4 and the bypass line 12 is positioned upstream of the thermal accumulator 2, the auxiliary system 11 is positioned downstream of the thermal accumulator 2, and an entire portion of the bypass line 12 is laid outside of the thermal accumulator 2. The bypass line 12 may be connected to the line P3 and to the auxiliary system 11 and may convey the thermal medium flowing through the line P3 to the auxiliary system 11 by bypassing the thermal accumulator 2.

The auxiliary system 11 is supplied with a thermal medium (first thermal medium) from the thermal accumulator 2 via the line P1 and supplied with a thermal medium (second thermal medium) from the line P4 via the bypass line 12. The first thermal medium is a high-temperature thermal medium having been heated by the thermal accumulator 2 and the second thermal medium is a low-temperature thermal medium not having been heated by the thermal accumulator 2.

The auxiliary system 11 further supplies the steam generator 4 with a thermal medium (third thermal medium) via the line P2. When supplied with the first or second thermal medium, the auxiliary system 11 discharges the first or second thermal medium as the third thermal medium. On the other hand, when supplied with the first and second thermal media, the auxiliary system 11 discharges a thermal medium obtained by mixing the first and second thermal media as the third thermal medium. Accordingly, a thermal medium at a lower temperature than the first thermal medium but at a higher temperature than the second thermal medium can be discharged as the third thermal medium. A temperature of the third thermal medium can be adjusted by controlling a ratio between a flow rate of the first thermal medium and a flow rate of the second thermal medium. The third thermal medium discharged from the auxiliary system 11 is supplied to the steam generator 4 via the line P2.

The control apparatus 13 controls various operations of the thermal energy storage power plant in FIG. 2. For example, the control apparatus 13 controls a rotation speed of the thermal inlet fan 3, opening/closing of the turbine control valve 7, opening/closing of the turbine bypass valve 8, and operations of the auxiliary system 11. Further details of the control apparatus 13 will be provided later.

The power generation amount detector 14 detects a power generation amount of the power generator 5 and outputs a detection result of the power generation amount to the control apparatus 13. The pressure detector 15 detects pressure (main steam pressure) of steam that flows from the steam generator 4 to the turbine control valve 7 and the turbine bypass valve 8 and outputs a detection result of the pressure to the control apparatus 13. For example, when the turbine control valve 7 is open and the turbine bypass valve 8 is closed, the pressure detector 15 detects pressure of steam supplied to the steam turbine 6. On the other hand, when the turbine control valve 7 is closed and the turbine bypass valve 8 is open, the pressure detector 15 detects pressure of steam that flows into the condenser 9. The thermal energy storage power plant in FIG. 2 includes two lines that supply steam from the steam generator 4 to the steam turbine 6 and the pressure detector 15 is provided on one of these lines.

Figure 3:
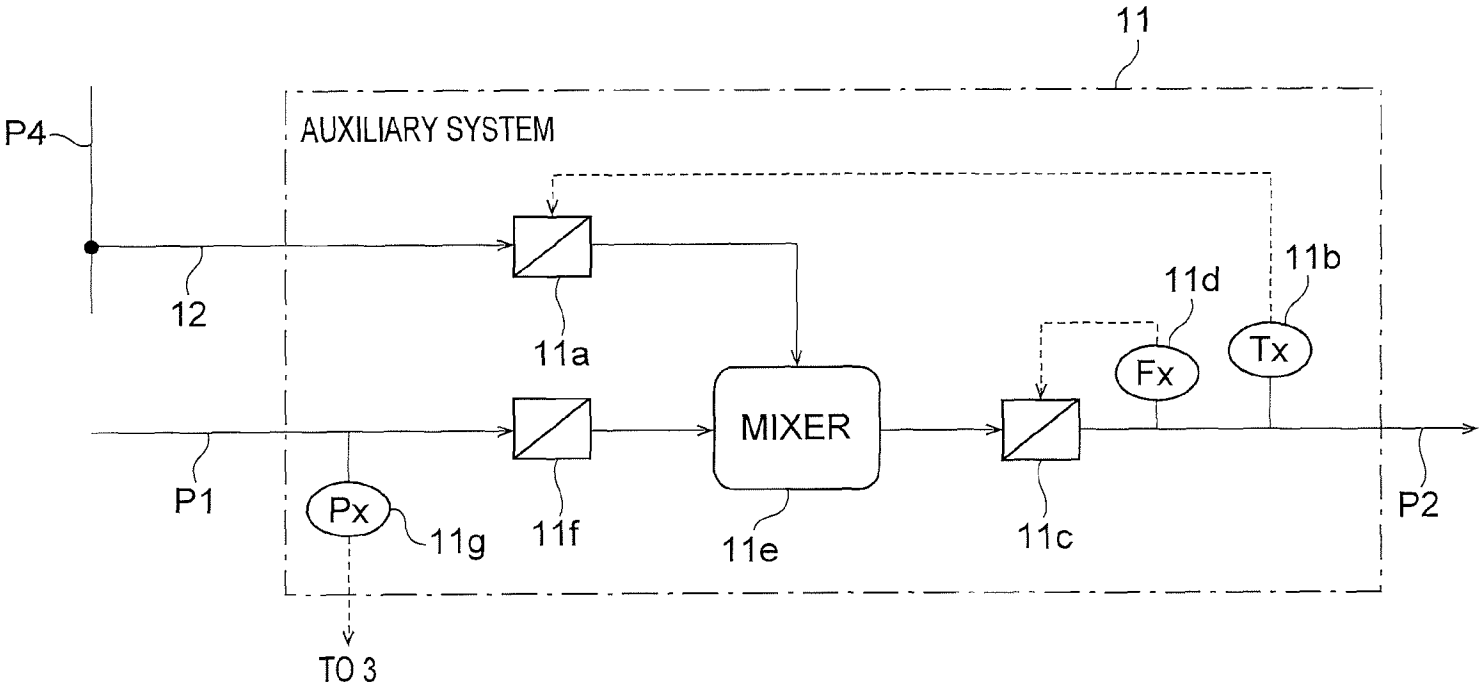
FIG. 3 is a schematic view illustrating a configuration of an auxiliary system of the first embodiment.

FIG. 3 is a schematic view illustrating a configuration of the auxiliary system 11 of the first embodiment. In FIG. 3, a system line is depicted by a solid line and a control line is depicted by a dashed line. This similarly applies to other drawings to be described later.

As illustrated in FIG. 3, the auxiliary system 11 includes a bypass damper 11*a*, a temperature detector 11*b*, a steam generator inlet damper 11*c*, a flow rate detector 11*d*, a mixer 11*e*, a thermal accumulator cut-off damper 11*f*, and a pressure detector 11*g*. The thermal accumulator cut-off damper 11*f* is an example of the first adjuster. The bypass damper 11*a* is an example of the second adjuster. The steam generator inlet damper 11*c* is an example of the third adjuster.

In the auxiliary system 11, flow paths of a thermal medium extend from the line P1, the line P2, and the bypass line 12 to the mixer 11*e*. In the description of the present embodiment, these flow paths will also be respectively referred to as the line P1, the line P2, and the bypass line 12.

The mixer 11*e* is disposed between the line P1 and the line P2 on the flow path from the thermal accumulator 2 to the steam generator 4 and is connected to the bypass line 12. Therefore, the mixer 11*e* is supplied with a thermal medium (first thermal medium) from the thermal accumulator 2 via the line P1, supplied with a thermal medium (second thermal medium) from the line P4 via the bypass line 12, and supplies the steam generator 4 with a thermal medium (third thermal medium) via the line P2. When supplied with the first or second thermal medium, the mixer 11*e* discharges the first or second thermal medium as the third thermal medium. On the other hand, when supplied with the first and second thermal media, the mixer 11*e* mixes the first thermal medium and the second thermal medium with each other and discharges a thermal medium obtained by the mixing as the third thermal medium. The third thermal medium discharged from the mixer 11*e* is supplied to the steam generator 4 via the line P2.

The bypass damper 11*a* is provided on the bypass line 12 in the auxiliary system 11 and is used to adjust a flow rate of the second thermal medium that flows through the bypass line 12. The temperature detector 11*b* is provided on the line P2 in the auxiliary system 11 and detects a temperature of the third thermal medium flowing through the line P2 and outputs a detection result of the temperature to the control apparatus 13. The temperature corresponds to the temperature of the thermal medium at an inlet of the steam generator 4. As will be described later, by controlling the bypass damper 11*a* based on the temperature detected by the temperature detector 11*b*, the control apparatus 13 can control the temperature of the third thermal medium flowing through the line P2.

The steam generator inlet damper 11*c* is provided on the line P2 in the auxiliary system 11 and is used to adjust a flow rate of the third thermal medium that flows through the line P2. The flow rate detector 11*d* is provided on the line P2 in the auxiliary system 11 and detects a flow rate of the third thermal medium flowing through the line P2 and outputs a detection result of the flow rate to the control apparatus 13. The flow rate corresponds to the flow rate of the thermal medium at the inlet of the steam generator 4. As will be described later, by controlling the steam generator inlet damper 11*c* based on the flow rate detected by the flow rate detector 11*d*, the control apparatus 13 can control the flow rate of the third thermal medium flowing through the line P2.

The thermal accumulator cut-off damper 11*f* is provided on the line P1 in the auxiliary system 11 and is used to adjust a flow rate of the first thermal medium that flows through the line P1. In the thermal energy storage power plant in FIG. 2, forced cooling of the plant must be performed during maintenance of the plant or the like. During forced cooling of the plant, the control apparatus 13 fully closes the thermal accumulator cut-off damper 11*f*. As a result, supply of the thermal medium to the thermal accumulator 2 is stopped, the thermal medium heated by the thermal accumulator 2 is no longer supplied to the steam generator 4, and the thermal medium no longer passes through the thermal accumulator 2. Therefore, the steam generator 4 is supplied with the thermal medium in a state where the temperature of the thermal medium is not high. Accordingly, this makes it possible to quickly cool the steam generator 4 and to stop the steam generator 4 in a short time. When the thermal accumulator cut-off damper 11*f* is fully closed, the entire thermal medium having flowed into the connection point of the line P4 and the bypass line 12 is to flow into the bypass line 12. The thermal accumulator cut-off damper 11*f* may be enabled to assume only two states of an open state and a closed state or may be enabled to assume a plurality of opening degrees.

The pressure detector 11*g* is provided on the line P1 in the auxiliary system 11 and detects pressure of the first thermal medium flowing through the line P1, and outputs a detection result of the pressure to the control apparatus 13. The pressure corresponds to pressure of the thermal medium at the outlet of the thermal accumulator 2. As will be described later, by controlling the thermal inlet fan 3 based on the pressure detected by the pressure detector 11*g*, the control apparatus 13 can control the pressure of the first thermal medium flowing through the line P1.

According to the present embodiment, the temperature of the thermal medium at the inlet of the steam generator 4 and the flow rate of the thermal medium at the inlet of the steam generator 4 can be independently controlled. Unless the temperature and the flow rate are independently controlled, control by the adjuster that controls the temperature of the thermal medium at the inlet of the steam generator 4 and control by the adjuster that controls the flow rate of the thermal medium at the inlet of the steam generator 4 take time to converge.

More specifically, in the present embodiment, the temperature of the thermal medium at the inlet of the steam generator 4 can be controlled by the bypass damper 11*a* and the flow rate of the thermal medium at the inlet of the steam generator 4 can be controlled by the steam generator inlet damper 11*c*.

On the other hand, for example, by providing the adjuster that performs control of the flow rate of the thermal medium at the inlet of the steam generator 4 on the line P1 instead of on the line P2, due to an operation of the adjuster, a ratio between the flow rate of the thermal medium flowing through the bypass line 12 and the flow rate of the thermal medium flowing through the line P1 changes and, accordingly, the temperature of the thermal medium at the inlet of the steam generator 4 changes. Accordingly, the adjuster (bypass damper 11*a*) that performs control of the temperature of the thermal medium at the inlet of the steam generator 4 operates and, accordingly, the flow rate of the thermal medium at the inlet of the steam generator 4 changes. Accordingly, the adjuster that performs control of the flow rate of the thermal medium at the inlet of the steam generator 4 operates, and since interlock between operations of both adjusters is to be repetitively performed until the operations converge, it takes time for the temperature and the flow rate of the thermal medium at the inlet of the steam generator 4 to converge.

Conversely, according to the present embodiment, providing the adjuster that performs control of the flow rate of the thermal medium at the inlet of the steam generator 4 on the line P2 enables interference of control to be suppressed and the time required by the temperature and the flow rate of the thermal medium at the inlet of the steam generator 4 to converge is reduced.

Figure 4:
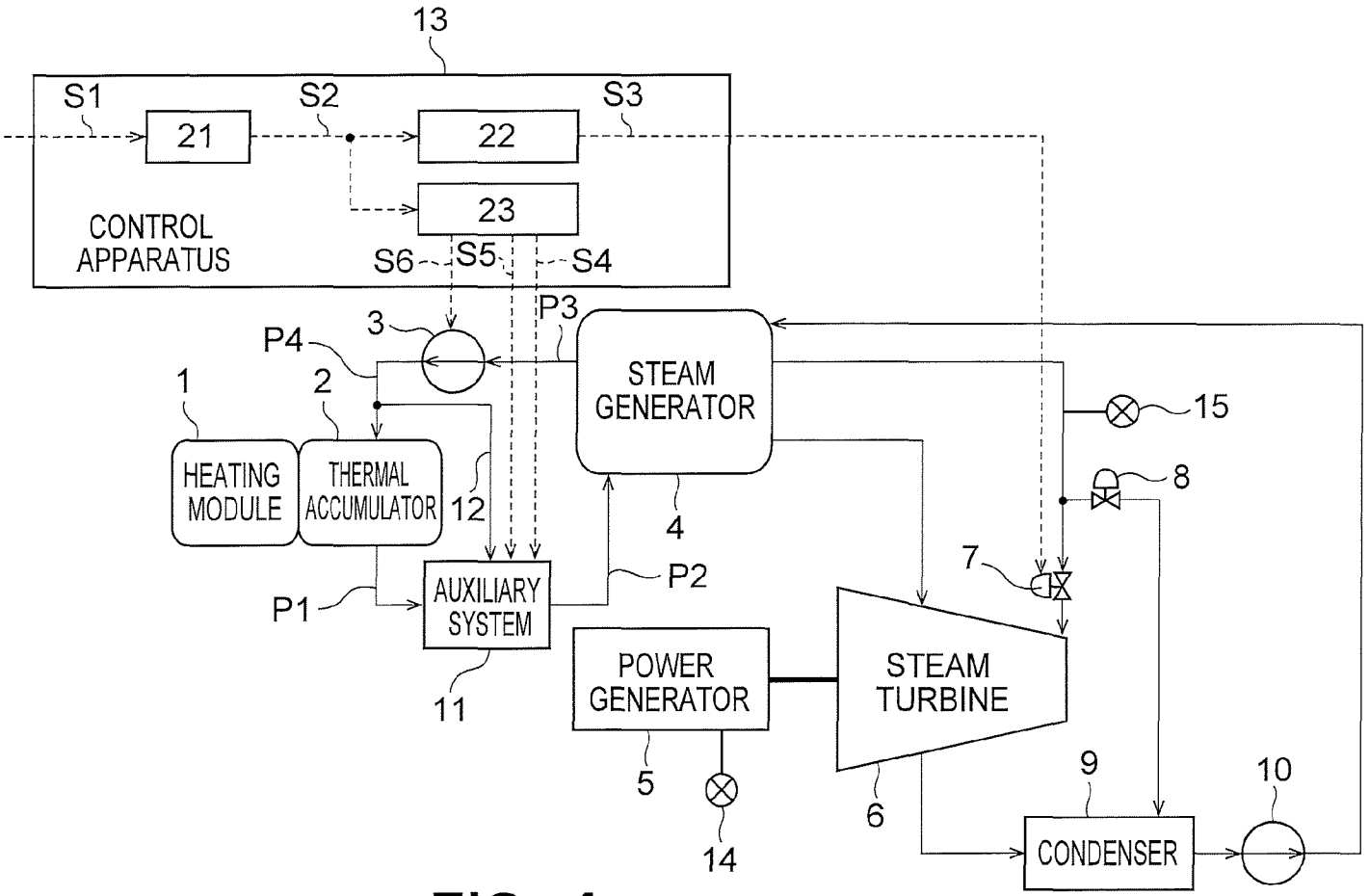
FIG. 4 is another schematic view illustrating a configuration of the thermal energy storage power plant of the first embodiment.

FIG. 4 is another schematic view illustrating a configuration of the thermal energy storage power plant of the first embodiment.

FIG. 4 illustrates details of the control apparatus 13 in addition to the contents illustrated in FIG. 2. As illustrated in FIG. 4, the control apparatus 13 includes a unit master controller 21, a turbine controller 22, and an auxiliary system controller 23.

The unit master controller 21 receives a signal S1 indicating a required power generation amount to the plant from a central power feed command center of the thermal energy storage power plant of the present embodiment. The required power generation amount may be input to the control apparatus 13 by an operator of the control apparatus 13. The unit master controller 21 further outputs a signal S2 indicating a unit load setting value (MWD) based on the signal S1. The signal S2 is outputted to the turbine controller 22 and the auxiliary system controller 23.

The turbine controller 22 performs load control of the thermal energy storage power plant of the present embodiment based on the signal S2. More specifically, the turbine controller 22 calculates a command value of the turbine control valve 7 based on the signal S2 and outputs a signal S3 indicating the command value to the turbine control valve 7. In this manner, the turbine controller 22 is capable of controlling a flow rate of steam to be supplied to the steam turbine 6 from the turbine control valve 7.

The auxiliary system controller 23 controls the auxiliary system 11 based on the signal S2 and, furthermore, controls the thermal inlet fan 3 based the signal S2. More specifically, the auxiliary system controller 23 calculates command values of the bypass damper 11*a*, the steam generator inlet damper 11*c*, and the thermal inlet fan 3 based on the signal S2 and respectively outputs signals S4, S5, and S6 indicating the command values to the bypass damper 11*a*, the steam generator inlet damper 11*c*, and the thermal inlet fan 3. In this manner, the auxiliary system controller 23 is capable of controlling a temperature, a flow rate, and pressure of a thermal medium.

As will be described later, an operation of the auxiliary system controller 23 is interlocked with an operation of the turbine controller 22 due to various factors. This makes it possible for the control apparatus 13 to integrate the steam turbine 6 and the auxiliary system 11 into one unit and to cause the steam turbine 6 and the auxiliary system 11 to operate in cooperation with each other. For example, when the required power generation amount from the central power feed command center decreases, thermal energy supplied from the thermal accumulator 2 to the steam generator 4 may be reduced instead of discarding steam to the condenser 9. Accordingly, for example, this makes it possible to promptly respond to a change in the required power generation amount or to suppress a decline in efficiency of the plant caused by discarding steam.

Figure 5:
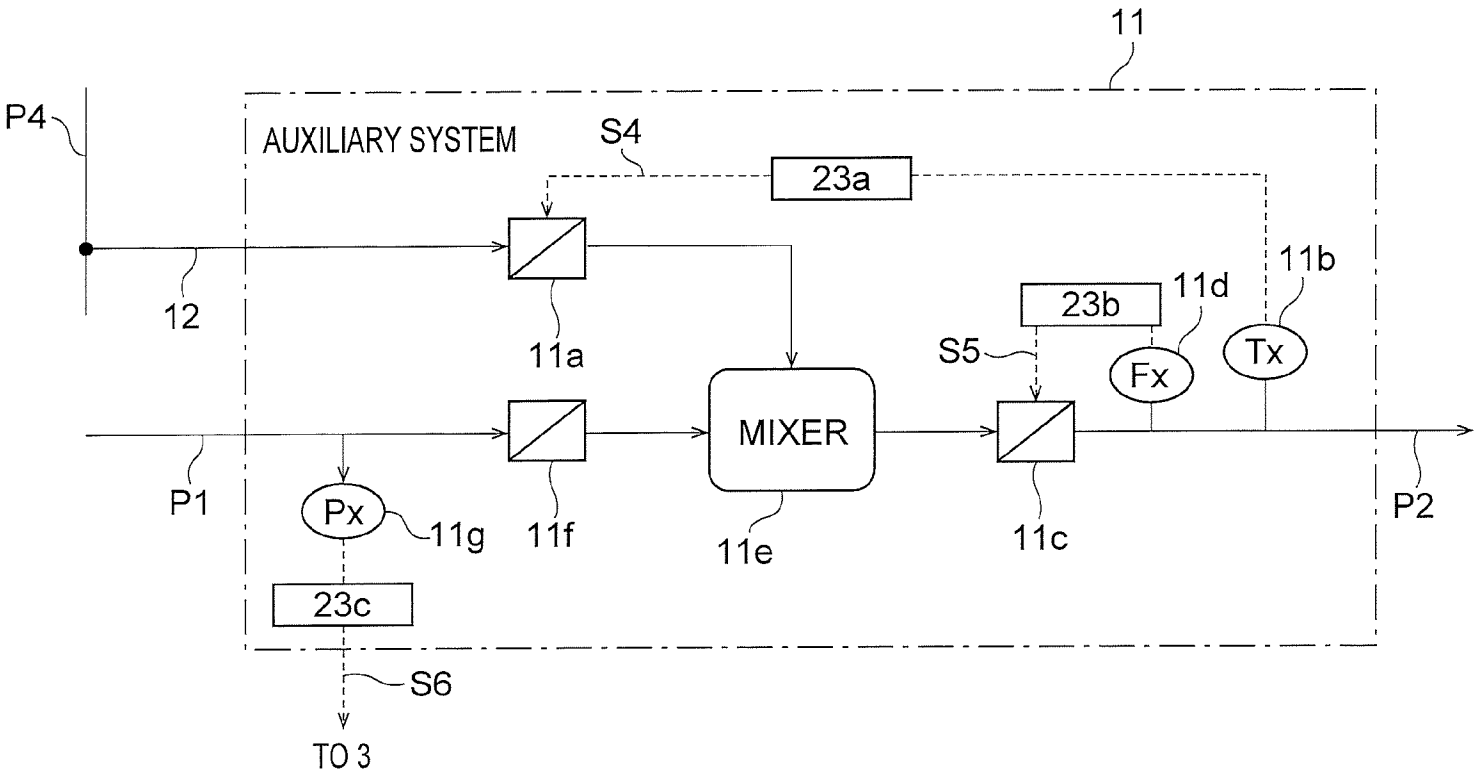
FIG. 5 is another schematic view illustrating a configuration of the auxiliary system of the first embodiment.

FIG. 5 is another schematic view illustrating a configuration of the auxiliary system 11 of the first embodiment.

FIG. 5 illustrates details of the control apparatus 13 in addition to the contents illustrated in FIG. 3. As illustrated in FIG. 5, the auxiliary system controller 23 of the control apparatus 13 includes a temperature controller 23*a*, a flow rate controller 23*b*, and a pressure controller 23*c*.

The temperature controller 23*a* controls the temperature of the third thermal medium flowing through the line P2 by controlling the bypass damper 11*a* according to the signal S4 based on the temperature detected by the temperature detector 11*b*. The flow rate controller 23*b* controls the flow rate of the third thermal medium flowing through the line P2 by controlling the steam generator inlet damper 11*c* according to the signal S5 based on the flow rate detected by the flow rate detector 11*d*. The pressure controller 23*c* controls the pressure of the first thermal medium flowing through the line P1 by controlling the thermal inlet fan 3 according to the signal S6 based on the pressure detected by the pressure detector 11*g*. The controls are performed based on the signal S2 indicating a MWD. Further details of the controls will be provided later.

Figure 6:
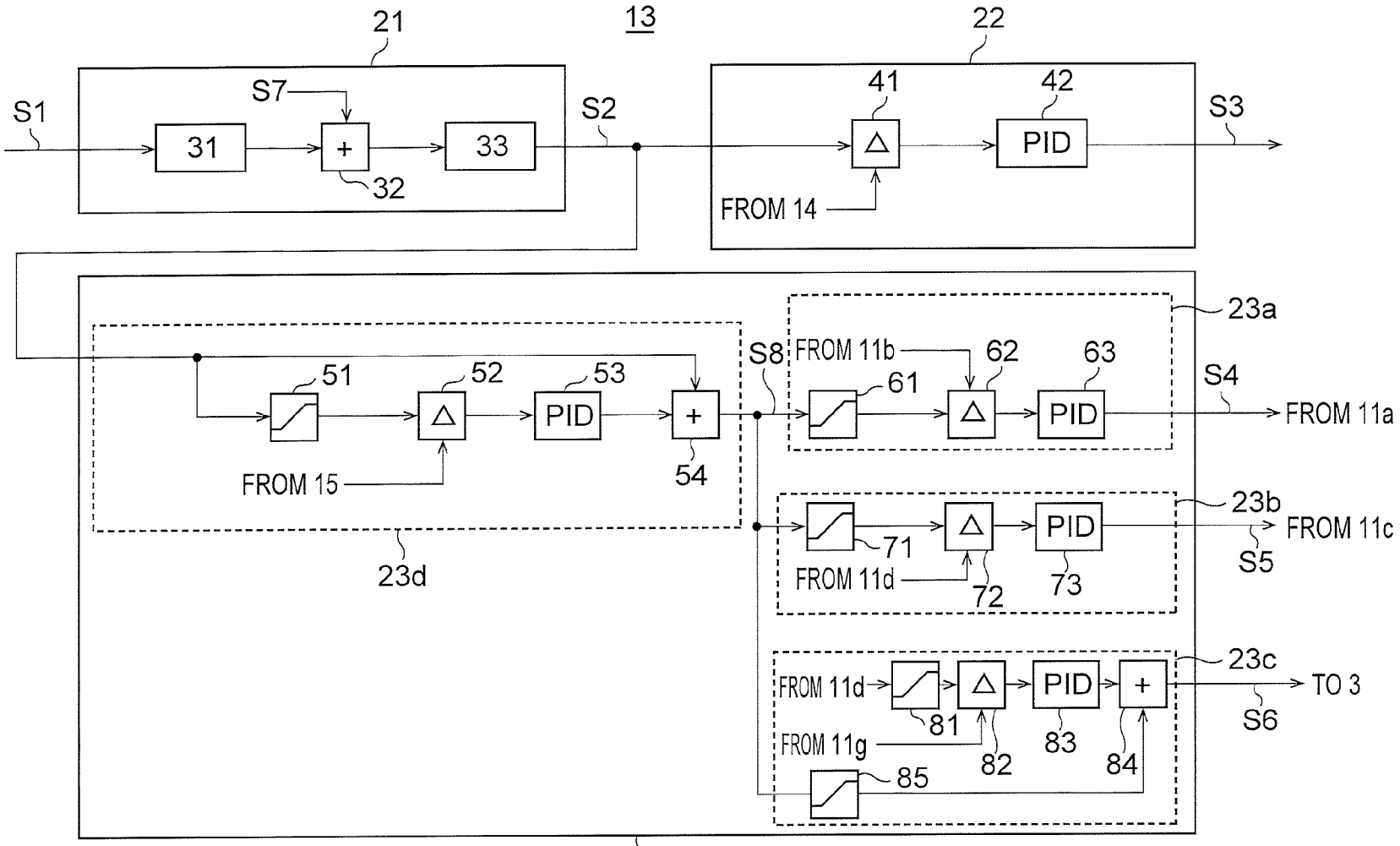
FIG. 6 is a functional block diagram illustrating a configuration of a control apparatus of the first embodiment.

FIG. 6 is a functional block diagram illustrating a configuration of the control apparatus 13 of the first embodiment.

The unit master controller 21 includes a load change rate instrument 31, an adder 32, and a load setting upper/lower limiter 33, the turbine controller 22 includes a subtractor 41 and a PID (Proportional Integral Derivative) controller 42, and the auxiliary system controller 23 includes the temperature controller 23*a*, the flow rate controller 23*b*, the pressure controller 23*c*, and a master logic module 23*d*. The master logic module 23*d* is an example of the calculator.

In addition, the master logic module 23*d* includes a function generator 51, a subtractor 52, a PID controller 53, and an adder 54. The temperature controller 23*a* includes a function generator 61, a subtractor 62, and a PID controller 63. The flow rate controller 23*b* includes a function generator 71, a subtractor 72, and a PID controller 73. The pressure controller 23*c* includes a function generator 81, a subtractor 82, a PID controller 83, an adder 84, and a function generator 85.

The unit master controller 21 operates as follows. The load change rate instrument 31 receives the signal S1 indicating the required power generation amount to the thermal energy storage power plant of the present embodiment and limits a change rate of the MWD that is calculated from the required power generation amount. The adder 32 receives a signal S7 indicating a correction value due to a change in frequency or the like and adds the correction value to the MWD prior to correction to calculate the MWD after the correction. The load setting upper/lower limiter 33 limits the value of the MWD after the correction according to upper and lower limits based on a capacity or a limit of the plant. The unit master controller 21 outputs the signal S2 indicating the MWD outputted from the load setting upper/lower limiter 33.

The turbine controller 22 operates as follows. The subtractor 41 receives the signal S2 indicating the MWD from the unit master controller 21 and receives a power generation amount of the power generator 5 as detected by the power generation amount detector 14 and subtracts the power generation amount from the MWD. The PID controller 42 receives a deviation between the MWD and the power generation amount from the subtractor 41 and, based on the deviation, controls an opening degree of the turbine control valve 7 by feedback control (PID control). More specifically, the PID controller 42 calculates a command value of the turbine control valve 7 so as to cause the deviation to approach zero and outputs the signal S3 indicating the command value to the turbine control valve 7. In this manner, the turbine controller 22 is capable of controlling a flow rate of steam to be supplied to the steam turbine 6 from the turbine control valve 7 and, accordingly, the power generation amount of the power generator 5 can be controlled. The turbine controller 22 may receive a value other than the power generation amount related to the power generator 5 from a predetermined detector and control the turbine control valve 7 based on the value.

The auxiliary system controller 23 includes the master logic module 23*d* that performs upstream-side control, the flow rate controller 23*b* that performs downstream-side control (local control) based on the upstream-side control, the pressure controller 23*c*, and the master logic module 23*d*.

The master logic module 23*d* operates as follows. The function generator 51 receives the signal S2 indicating the MWD from the unit master controller 21 and calculates a setting value of main steam pressure from the MWD according to a function generated by the function generator 51. The subtractor 52 receives a measured value of the main steam pressure from the pressure detector 15 and subtracts the measured value of the main steam pressure from the setting value of the main steam pressure. The PID controller 53 receives a deviation between the setting value and the measured value from the subtractor 52 and, based on the deviation, determines a correction signal of a thermal outlet setting value by feedback control (PID control). More specifically, the PID controller 53 calculates a correction signal of the thermal outlet setting value so as to cause the deviation to approach zero. The adder 54 receives an MWD that is a base signal of the thermal outlet setting value from the unit master controller 21, receives the correction signal of the thermal outlet setting value from the PID controller 53, and adds the correction signal of the thermal outlet setting value to the base signal of the thermal outlet setting value. The master logic module 23*d* outputs a signal S8 indicating a thermal outlet setting value obtained by adding the correction signal to the base signal. The MWD that is the base signal of the thermal outlet setting value is an example of the first setting value and the thermal outlet setting value is an example of the second setting value.

The thermal outlet setting value of the present embodiment is used to control the temperature, the flow rate, and the pressure of the thermal medium at the outlet of the thermal accumulator 2. For example, the temperature controller 23*a* controls the temperature of the third thermal medium that flows through the line P2 based on the thermal outlet setting value. Furthermore, the flow rate controller 23*b* controls the flow rate of the third thermal medium that flows through the line P2 based on the thermal outlet setting value. Moreover, the pressure controller 23*c* controls pressure of the first thermal medium that flows through the line P1 based on the thermal outlet setting value. The present embodiment makes it possible to unify setting values for controlling the bypass damper 11*a*, the steam generator inlet damper 11*c*, and the thermal inlet fan 3 that are operation terminals of the thermal accumulator 2 to the thermal outlet setting value and, accordingly, to operate the operation terminals so as to cooperate with each other.

In the present embodiment, in order to supply a thermal output commensurate with the power generation amount of the power generator 5, the thermal outlet setting value is set based on the MWD. The thermal output refers to thermal energy that is dissipated from the thermal accumulator 2. Since the thermal outlet setting value of the present embodiment is calculated by adding a correction signal of the thermal outlet setting value to the MWD that is a base signal of the thermal outlet setting value, the thermal outlet setting value changes according to a change in the MWD.

Normally, even when the thermal outlet setting value is set to the MWD, a balance between the power generation amount and the thermal outlet is maintained. However, when the thermal outlet setting value is set to the MWD, an imbalance between the power generation amount and the thermal outlet is created when efficiency of the steam turbine 6 changes or when a load of the thermal energy storage power plant changes. In consideration thereof, the thermal outlet setting value of the present embodiment is set to a sum of the MWD that is the base signal and the correction signal. The correction signal is calculated based on main steam pressure detected by the pressure detector 15. Therefore, the present embodiment makes it possible to suppress an occurrence of an imbalance between the power generation amount and the thermal outlet by using such a thermal outlet setting value.

The master logic module 23*d* may receive a value other than main steam pressure related to a main steam from a predetermined detector and may calculate the thermal outlet setting value based on the value. In addition, while the master logic module 23*d* calculates a thermal outlet setting value with same dimensions as an MWD in the present embodiment, a thermal outlet setting value with different dimensions from the MWD may be calculated instead.

The temperature controller 23*a* operates as follows. The function generator 61 receives the signal S8 indicating a thermal outlet setting value from the master logic module 23*d* and calculates a setting value of a steam generator inlet temperature from the thermal outlet setting value according to a function generated by the function generator 61. The steam generator inlet temperature corresponds to the temperature of the thermal medium at an inlet of the steam generator 4 and is measured by the temperature detector 11*b*. The subtractor 62 receives a measured value of the steam generator inlet temperature from the temperature detector 11*b* and subtracts the measured value of the steam generator inlet temperature from the setting value of the steam generator inlet temperature. The PID controller 63 receives a deviation between the setting value and the measured value from the subtractor 62 and, based on the deviation, controls an opening degree of the bypass damper 11*a* by feedback control (PID control). More specifically, the PID controller 63 calculates a command value of the bypass damper 11*a* so as to cause the deviation to approach zero and outputs the signal S4 indicating the command value to the bypass damper 11*a*.

In this manner, the temperature controller 23*a* of the present embodiment can control the temperature of the third thermal medium that flows through the line P2 and, accordingly, control the temperature of the thermal medium at the outlet of the thermal accumulator 2.

The flow rate controller 23*b* operates as follows. The function generator 71 receives the signal S8 indicating a thermal outlet setting value from the master logic module 23*d* and calculates a setting value of a steam generator inlet flow rate from the thermal outlet setting value according to a function generated by the function generator 71. The steam generator inlet flow rate corresponds to the flow rate of the thermal medium at an inlet of the steam generator 4 and is measured by the flow rate detector 11*d*. The subtractor 72 receives a measured value of the steam generator inlet flow rate from the flow rate detector 11*d* and subtracts the measured value of the steam generator inlet flow rate from the setting value of the steam generator inlet flow rate. The PID controller 73 receives a deviation between the setting value and the measured value from the subtractor 72 and, based on the deviation, controls an opening degree of the steam generator inlet damper 11*c* by feedback control (PID control). More specifically, the PID controller 73 calculates a command value of the steam generator inlet damper 11*c* so as to cause the deviation to approach zero and outputs the signal S5 indicating the command value to the steam generator inlet damper 11*c*.

In this manner, the flow rate controller 23*b* of the present embodiment can control the flow rate of the third thermal medium that flows through the line P2 and, accordingly, control the flow rate of the thermal medium at the outlet of the thermal accumulator 2.

The pressure controller 23*c* operates as follows. The function generator 85 receives the signal S8 indicating a thermal outlet setting value from the master logic module 23*d* and calculates a correction value for a command value of the thermal inlet fan 3 from the thermal outlet setting value according to a function generated by the function generator 85. The thermal output pressure corresponds to pressure of the thermal medium at the outlet of the thermal accumulator 2 and is measured by the pressure detector 11*g*. The function generator 81 receives a measured value of the steam generator inlet flow rate from the flow rate detector 11*d* and calculates a setting value of thermal outlet pressure commensurate with the measured value of the steam generator inlet flow rate according to a function generated by the function generator 81. The subtractor 82 receives a measured value of the thermal outlet pressure from the pressure detector 11*g* and subtracts the measured value of the thermal outlet pressure from the setting value of the thermal outlet pressure. The PID controller 83 receives a deviation between the setting value and the measured value from the subtractor 82 and, based on the deviation, determines a rotation speed of the thermal inlet fan 3 by feedback control (PID control). More specifically, the PID controller 83 calculates a command value of the thermal inlet fan 3 so as to cause the deviation to approach zero. The adder 84 adds the correction value calculated by the function generator 85 to the command value calculated by the PID controller 83. The adder 84 outputs the signal S6 indicating the command value after correction that is obtained by adding the correction value to the command value prior to the correction to the thermal inlet fan 3.

In this manner, the pressure controller 23*c* of the present embodiment can control the pressure of the first thermal medium that flows through the line P1 and, accordingly, control the pressure of the thermal medium at the outlet of the thermal accumulator 2. In the pressure controller 23*c* of the present embodiment, it is difficult to sufficiently improve operation performance of the thermal energy storage power plant when load changes at high speed only by feedback control of the PID controller 83. Therefore, the pressure controller 23*c* of the present embodiment corrects, using feed-forward control by the adder 84, a command value obtained using feedback control. This makes it possible to sufficiently improve the operation performance of the thermal energy storage power plant even when load changes at high speed.

As described above, the thermal energy storage power plant of the present embodiment includes the auxiliary system 11 provided between the line P1 and the line P2 and the bypass line 12 that supplies the auxiliary system 11 with a thermal medium from the line P4 by bypassing the thermal accumulator 2. This makes it possible to perform load control of the present embodiment using not only the control valve 7 but also using the auxiliary system 11 and to assist, by the auxiliary system 11, load control by the control valve 7. Conventionally, unnecessary steam has been discarded to the condenser 9 when desiring to reduce an amount of supplied steam. However, the present embodiment makes it possible to efficiently realize thermal energy storage by controlling supply of steam from the steam generator 4 by the auxiliary system 11. The present embodiment makes it possible to realize such highly-efficient thermal energy storage by controlling the auxiliary system 11 and the like with the control apparatus 13.

As described earlier, the amount of heat Q of the thermal storage material in the thermal accumulator 2 bears a proportionate relationship to the mass M of the thermal storage material, the specific heat Cp of the thermal storage material, and a difference in temperature $\Delta T$ (=T1−T2) between the heat input temperature T1 to the thermal accumulator 2 and the heat output temperature T2 ($Q=M\times Cp\times \Delta T$). Since the present embodiment makes it possible to control heat supply to the steam generator 4 by the auxiliary system 11, the thermal accumulator 2 can accumulate heat at a high temperature and the heat input temperature T1 to the thermal accumulator 2 in the equation provided above can be raised. Therefore, a large amount of heat Q can be obtained with a small mass M and a size of the thermal accumulator 2 can be reduced.

Furthermore, by raising the heat input temperature T1 to the thermal accumulator 2, a constraint placed on the thermal medium temperature can be resolved. Therefore, instead of being limited to crushed stone, concrete, ceramics, and the like, this makes it possible to expand the types of the thermal storage material in the thermal accumulator 2 to latent heat thermal storage materials (for example, an alloy PCM) and chemical thermal storage materials (for example, $LiSiO_4$) capable of storing heat at higher temperatures and higher densities. In this manner, the present embodiment makes it possible to flexibly select a type of the thermal storage material in the thermal accumulator 2, to achieve space-saving of the thermal accumulator 2, and to realize thermal energy storage capable of maintaining high power generation/thermal efficiency.

In addition, in the present embodiment, the thermal accumulator cut-off damper 11*f* for performing forced cooling of the steam generator 4 during maintenance of the steam generator 4 and the like is provided. When the thermal accumulator cut-off damper 11*f* is cut off, a thermal medium that attempts to return to the thermal accumulator 2 from the steam generator 4 does not return to the thermal accumulator 2 but flows to the steam generator 4 through the bypass line 12. Therefore, as a result of early cooling of the steam generator 4 due to circulation between the thermal accumulator 2 and the steam generator 4 of the thermal medium that does not pass through the thermal accumulator 2, a time until start of maintenance of the steam generator 4 can be reduced.

Second Embodiment

Figure 7:
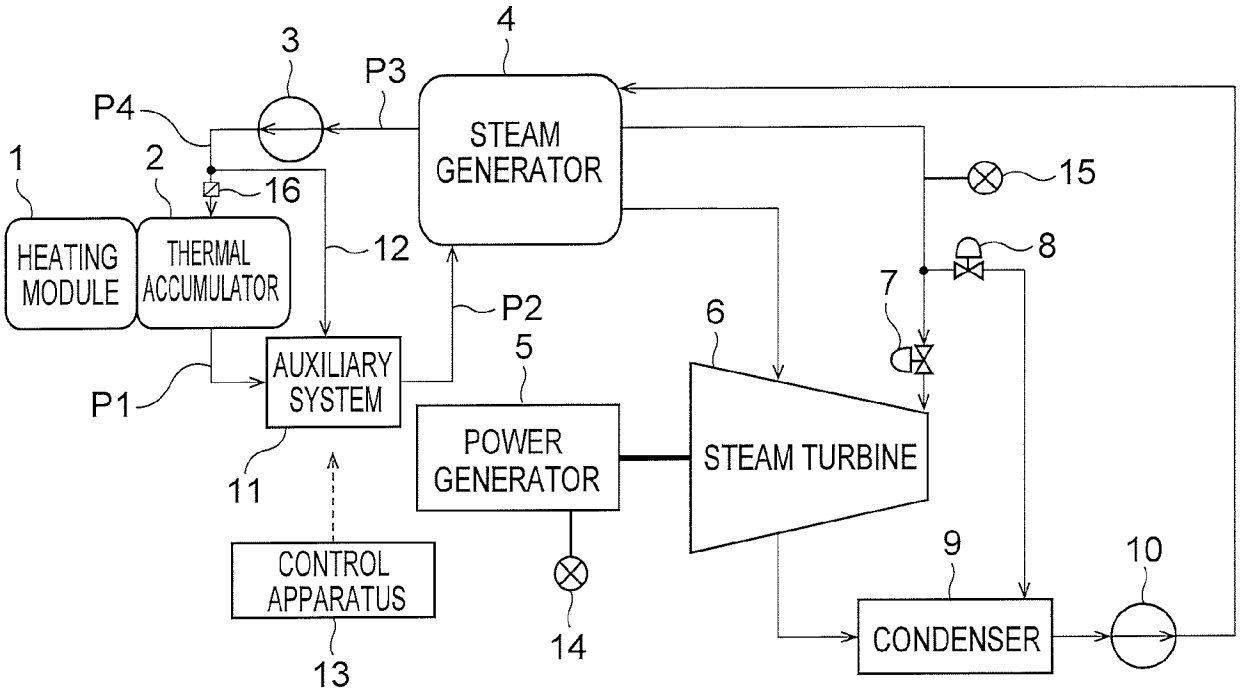
FIG. 7 is a schematic view illustrating a configuration of a thermal energy storage power plant of a second embodiment.

FIG. 7 is a schematic view illustrating a configuration of a thermal energy storage power plant of a second embodiment.

The thermal energy storage power plant in FIG. 7 has a similar configuration to the thermal energy storage power plant in FIG. 2. However, the thermal energy storage power plant in FIG. 7 includes a thermal accumulator cut-off damper 16 in place of the thermal accumulator cut-off damper 11*f* or in addition to the thermal accumulator cut-off damper 11*f*. The thermal accumulator cut-off damper 16 is an example of the fourth adjuster.

The thermal accumulator cut-off damper 16 is provided on the line P4 and is used to adjust a flow rate of a thermal medium that flows through the line P4. In FIG. 7, the thermal accumulator cut-off damper 16 is disposed downstream of a connection point of the line P4 and the bypass line 12. In the thermal energy storage power plant in FIG. 7, forced cooling of the plant must be performed during maintenance of the plant or the like. During forced cooling of the plant, the control apparatus 13 fully closes the thermal accumulator cut-off damper 16. As a result, supply of the thermal medium to the thermal accumulator 2 is stopped and the thermal medium heated by the thermal accumulator 2 is no longer supplied to the steam generator 4. This makes it possible to quickly cool the steam generator 4 and to stop the steam generator 4 in a short time. When the thermal accumulator cut-off damper 16 is fully closed, the entire thermal medium having flowed into the connection point of the line P4 and the bypass line 12 is to flow into the bypass line 12. The thermal accumulator cut-off damper 16 may be enabled to assume only two states of an open state and a closed state or may be enabled to assume a plurality of opening degrees.

The thermal accumulator cut-off damper 11*f* and the thermal accumulator cut-off damper 16 will now be compared with each other. Since the thermal accumulator cut-off damper 11*f* is disposed downstream of the thermal accumulator 2, a high-temperature thermal medium after being heated by the thermal accumulator 2 flows into the thermal accumulator cut-off damper 11*f*. On the other hand, since the thermal accumulator cut-off damper 16 is disposed upstream of the thermal accumulator 2, a low-temperature thermal medium before being heated by the thermal accumulator 2 flows into the thermal accumulator cut-off damper 16. Therefore, for example, using the thermal accumulator cut-off damper 16 has an advantage of enabling thermal deterioration of the thermal accumulator cut-off damper 16 to be suppressed and an advantage of enabling the thermal accumulator cut-off damper 16 with low heat resistance to be adopted.

In a similar manner, the thermal energy storage power plant in FIG. 7 may include a damper for flow rate adjustment on the line P4 in place of the steam generator inlet damper 11*c* or in addition to the steam generator inlet damper 11*c*. For example, the damper is disposed upstream of the connection point of the line P4 and the bypass line 12 and is controlled by the control apparatus 13 using a similar control method to the steam generator inlet damper 11*c*. For example, using such a damper has an advantage of enabling thermal deterioration of the damper to be suppressed and an advantage of enabling a damper with low heat resistance to be adopted. On the other hand, for example, using the steam generator inlet damper 11*c* has an advantage of improved responsiveness of flow rate control since the steam generator inlet damper 11*c* and the flow rate detector 11*d* can be disposed close to each other.

While certain embodiments have been described, these embodiments have been presented by way of example only, and are not intended to limit the scope of the inventions. Indeed, the novel plants described herein may be embodied in a variety of other forms; furthermore, various omissions, substitutions and changes in the form of the plants described herein may be made without departing from the spirit of the inventions. The accompanying claims and their equivalents are intended to cover such forms or modifications as would fall within the scope and spirit of the inventions.

The invention claimed is:

1. A thermal energy storage power plant comprising:

a thermal accumulator configured to accumulate thermal energy supplied from a heating module, and heat a thermal medium as air with the thermal energy;

a steam generator configured to generate steam using heat of the thermal medium heated by the thermal accumulator;

a first flow path configured to convey the thermal medium from the thermal accumulator to the steam generator;

a second flow path configured to convey the thermal medium from the steam generator to the thermal accumulator;

an auxiliary module provided on the first flow path; and a bypass flow path configured to convey the thermal medium flowing through the second flow path to the auxiliary module by bypassing the thermal accumulator, wherein the auxiliary module is supplied with a first thermal medium as the thermal medium from the thermal accumulator via the first flow path, the auxiliary module is supplied with a second thermal medium as the thermal medium from the second flow path via the bypass flow path, the auxiliary module generates a third thermal medium as the thermal medium using the first thermal medium and the second thermal medium, the auxiliary module supplies the third thermal medium to the steam generator via the first flow path, and the steam generator generates the steam using heat of the third thermal medium.

2. The plant of claim 1, wherein the auxiliary module includes a mixer configured to mix the first thermal medium and the second thermal medium, and discharges the third thermal medium from the mixer.

3. The plant of claim 1, wherein the auxiliary module includes a first adjuster configured to adjust a flow rate of the first thermal medium, and the first adjuster stops supply of the thermal medium to the thermal accumulator during forced cooling of the thermal energy storage power plant.

4. The plant of claim 1, wherein the auxiliary module includes a second adjuster configured to adjust a flow rate of the second thermal medium.

5. The plant of claim 1, wherein the auxiliary module includes a third adjuster configured to adjust a flow rate of the third thermal medium.

6. The plant of claim 1, further comprising a fourth adjuster provided on the second flow path, and configured to adjust a flow rate of the thermal medium, wherein the fourth adjuster stops supply of the thermal medium to the thermal accumulator during forced cooling of the thermal energy storage power plant.

7. The plant of claim 1, further comprising a rotating device provided on the first flow path or the second flow path, and configured to circulate the thermal medium between the thermal accumulator and the steam generator.

8. The plant of claim 1, further comprising:

a steam turbine configured to be driven by the steam supplied from the steam generator;

a power generator configured to be driven by the steam turbine;

a steam detector configured to detect a value related to the steam supplied from the steam generator; and a control apparatus configured to control the auxiliary module, based on the value detected by the steam detector.

9. The plant of claim 8, wherein the steam detector detects pressure of the steam supplied from the steam generator.

10. The plant of claim 8, further comprising:

a control valve configured to control supply of the steam from the steam generator to the steam turbine; and a power generation detector configured to detect a value related to the power generator, wherein the control apparatus further controls the control valve, based on the value detected by the power generation detector.

11. The plant of claim 10, wherein the power generation detector detects a power generation amount of the power generator.

12. The plant of claim 8, wherein the control apparatus includes:

a calculator configured to acquire a first setting value for control of the auxiliary module, and calculate a second setting value for control of the auxiliary module, based on the value detected by the steam detector and the first setting value;

a temperature controller configured to control a temperature of the third thermal medium, based on the second setting value;

a flow rate controller configured to control a flow rate of the third thermal medium, based on the second setting value; and a pressure controller configured to control pressure of the first thermal medium, based on the second setting value.

13. The plant of claim 12, wherein the auxiliary module includes a temperature detector configured to detect the temperature of the third thermal medium, and a second adjuster configured to adjust a flow rate of the second thermal medium, and the temperature controller controls the temperature of the third thermal medium, by controlling the second adjuster based on the temperature detected by the temperature detector.

14. The plant of claim 12, wherein the auxiliary module includes a flow rate detector configured to detect the flow rate of the third thermal medium, and a third adjuster configured to adjust the flow rate of the third thermal medium, and the flow rate controller controls the flow rate of the third thermal medium, by controlling the third adjuster based on the flow rate detected by the flow rate detector.

15. The plant of claim 12, further comprising a rotating device provided on the first flow path or the second flow path, and configured to circulate the thermal medium between the thermal accumulator and the steam generator, wherein the auxiliary module includes a pressure detector configured to detect pressure of the first thermal medium, and the pressure controller controls the pressure of the first thermal medium, by controlling the rotating device based on the pressure detected by the pressure detector.

* * * * *